United States Patent [19]

Miura

[11] Patent Number: 4,701,580

[45] Date of Patent: Oct. 20, 1987

[54] SIMULTANEOUS INTER-ROW LOCKING INHIBITING MECHANISM FOR A MULTI-ROW INTERLOCKING SWITCH DEVICE

[75] Inventor: Teiichi Miura, Furukawa, Japan

[73] Assignee: Alps Electric Co., Ltd., Japan

[21] Appl. No.: 861,427

[22] Filed: May 9, 1986

[30] Foreign Application Priority Data

May 9, 1985 [JP] Japan ..... 60-68334[U]

[51] Int. Cl.[4] ..... H01H 9/26

[52] U.S. Cl. ..... 200/5 E; 200/5 EA

[58] Field of Search ..... 200/5 B, 5 C, 5 D, 5 E, 200/5 EA, 5 EB, 5 OC

[56] References Cited

U.S. PATENT DOCUMENTS 3,271,529 9/1966 Pawelka et al. ..... 200/5 C 3,544,739 12/1970 Shah ..... 200/5 E 3,970,806 7/1976 Distler ..... 200/5 E X 4,297,541 10/1981 Niinuma ..... 200/5 E

*Primary Examiner*—J. R. Scott

*Attorney, Agent, or Firm*—Guy W. Shoup

[57] ABSTRACT

A mechanism for inhibiting simultaneous locking of switches in a plurality of rows in a multi-row switch device has a member for inhibiting simultaneous locking of switches in two rows. The member has a plurality of receiving portions projectingly formed in a spaced relationship by a fixed distance and an alternate relationship on both edges thereof and located corresponding to the keys in the two rows. When one of the switches in one row is operated, the member is moved to a position in which the receiving portions thereof will inhibit the corresponding keys in the other row from being depressed. The switch device also includes bar-like locking cams extending between every two adjacent switches in each row for preventing simultaneous locking of two switches in the same row.

5 Claims, 9 Drawing Figures

SIMULTANEOUS INTER-ROW LOCKING INHIBITING MECHANISM FOR A MULTI-ROW INTERLOCKING SWITCH DEVICE

BACKGROUND OF THE INVENTION

This invention relates to a mechanism for inhibiting simultaneous locking of switches in a plurality of rows in a multi-row interlocking switch device.

Conventionally, an inhibiting mechanism for inhibiting simultaneous locking of a plurality of switches in an interlocking multiple switch device is already known. However, no proposal has yet been made for a mechanism for inhibiting simultaneous locking of switches in two or more different rows in a multi-row interlocking switch device which includes a plurality of rows of such interlocking switches provided in a juxtaposed relationship therein. Therefore, a plurality of switches which must not be locked at a time must be disposed in a serial row. As a result, additional spacing for installation of inhibiting devices for each row is required accordingly.

SUMMARY OF THE INVENTION

It is an object of the present invention to provide a mechanism for inhibiting simultaneous locking of switches in a plurality of rows in a multi-row interlocking switch device which mechanism eliminates such problems of the prior art device as described above and can inhibit simultaneous locking of switches in different rows.

In order to attain the object, according to the present invention, a mechanism for inhibiting simultaneous locking of switches in a plurality of rows in a multi-row interlocking switch device comprises a chassis; a plurality of rows of switches mounted on the chassis; an interlocking cam located between adjacent ones of the rows of switches and having a plurality of engaging portions formed on opposite sides thereof; and a simultaneous locking inhibiting member located below the interlocking cam for inhibiting simultaneous locking of the switches in different ones of the rows of switches, the simultaneous locking inhibiting member having a plurality of receiving portions projectingly formed in a spaced relationship by a fixed distance on one of edges along the length thereof, each of the receiving portions of the simultaneous locking inhibiting member having a tapered face on one of opposite sides thereof, the simultaneous locking inhibiting member further having a plurality of receiving portions projectingly formed at positions on the other edge thereof each of which positions corresponds substantially to the center between adjacent ones of the receiving portions on the one edge of the simultaneous locking inhibiting member, each of the receiving portions on the other edge of the simultaneous locking inhibiting member having a tapered face on a side thereof opposite to the one side of the receiving portion on the one edge of the simultaneous locking inhibiting member.

DETAILED DESCRIPTION OF THE PREFERRED EMBODIMENT

Now, an embodiment of the present invention will be described with reference to the drawings.

Figure 1:
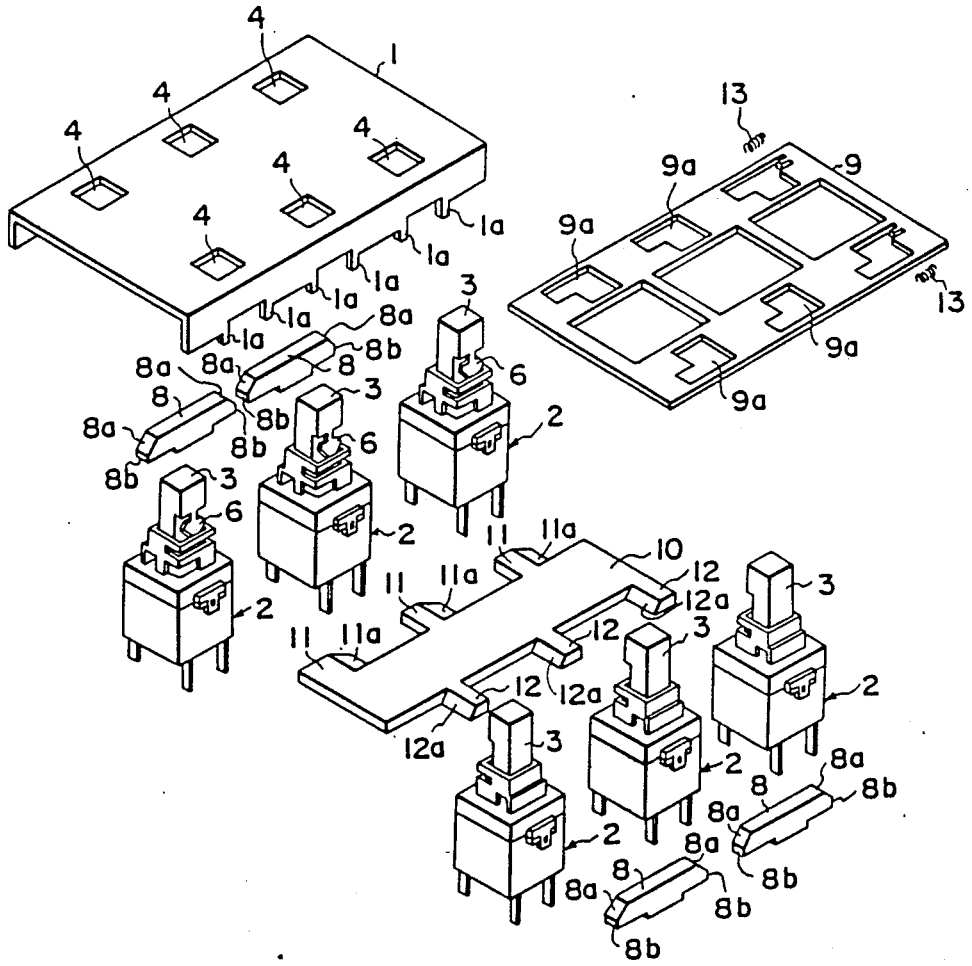
FIG. 1 is a fragmentary perspective view of a multi-row interlocking switch device which incorporates a simultaneous inter-row locking inhibiting mechanism embodying the present invention.
Figure 2:
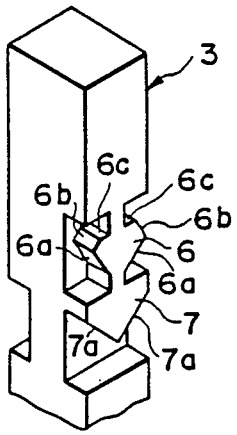
FIG. 2 is a perspective view showing a front wall face of a slide of a switch of the device of FIG. 1.
Figure 3:
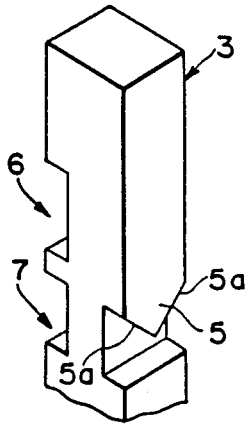
FIG. 3 is a perspective view showing a rear wall face of the slide of FIG. 2.
Figure 4:
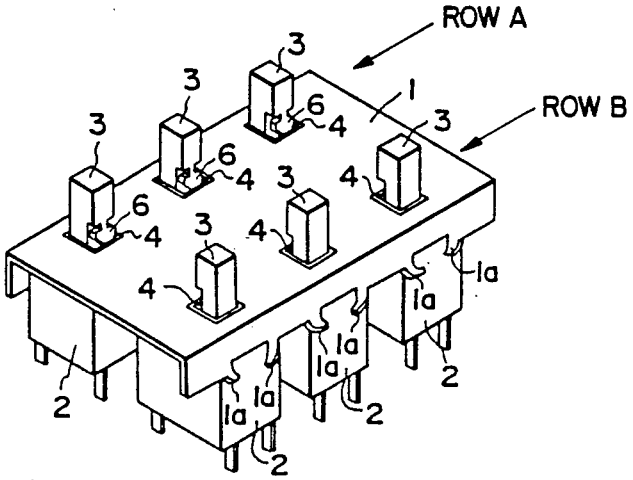
FIG. 4 is a perspective view of the multi-row interlocking switch device of FIG. 1 in its assembled form.

A multi-row interlocking switch device incorporating a simultaneous inter-row locking inhibiting mechanism embodying the present invention includes a chassis 1 which has a plurality of insertion holes 4 formed in a plurality of, two in the embodiment, parallel rows along and adjacent opposite side edges along the length thereof. A plurality of, that is, two, rows of switches 2 are mounted at caulking portions 1*a* of the chassis 1 by caulking and have slides 3 which extends at heads thereof through the insertion holes 4 of the chassis 1. Each of the slides 3 is urged upwardly by a spring not shown accommodated in the inside thereof as well known in the art and has a cam operating portion 5 for a locking cam, which will be hereinafter described, formed on a rear wall face thereof. The cam operating portion 5 presents a pair of tapered faces 5*a* formed to intersect each other thereon. The slide 3 further has an interlocking cam operating portion 6 for an interlocking cam, which will be hereinafter described, formed on a front wall face thereof, and a controlling portion 7 also formed on the front wall face thereof and located in a spaced relationship below the interlocking cam operating portion 6 for controlling a simultaneous inter-row locking inhibiting member which will also be described hereinafter. As shown in FIG. 2, the interlocking cam operating portion 6 of each slider 3 has a pair of tapered lowering guide faces 6*a* and a pair of tapered rising guide faces 6*b* both formed thereon with a pair of horizontal stopping faces 6*c* formed in a contiguous relationship to the tapered rising guide faces 6*b*. The controlling portion 7 has a pair of tapered faces 7*a* formed to intersect each other thereon.

Meanwhile, the multi-row interlocking switch device further includes a plurality of locking cams 8 which are each located between the slides 3 of every adjacent ones of the switches 2 in each row for engagement by the cam operating portions 5 of the associated slides 3 for preventing simultaneous locking of the switches in the row. The locking cam 8 is in the form of a straight bar and has formed on each of opposite ends thereof a tapered face 8*a* which is tapered in the same angle with the tapered face 5*a* of the cam operating portion 5 of the slide 3, and an abutting face 8*b* contiguous to the tapered face 8a for abutting engagement with one of the abutting faces 8b of an adjacent locking cam 8.

Further, the multi-row interlocking switch device includes an interlocking cam 9 which has a pair of rows of engaging portions 9a formed adjacent and along opposite edges thereof because the switches 2 are arranged in two rows as described above. Each of the engaging portions 9a of the interlocking cam 9 is provided for engagement with the interlocking cam operating portion 6 of a given slide 3. The interlocking cam 9 is thus disposed between the two rows of the switches 2.

The multi-row interlocking switch device further includes a simultaneous inter-row locking inhibiting member 10 located below the interlocking cam 9. The simultaneous inter-row locking inhibiting member 10 is in the form of a flat plate having a plurality of receiving portions 11 projectingly formed in a spaced relationship by a fixed distance on one of side edges along the length thereof. The receiving portions 11 of the simultaneous inter-row locking inhibiting member 10 have formed on same sides thereof in a direction a tapered face 11a which is tapered in the same angle with the tapered face 7a of the controlling portions 7 of the slides 3. Meanwhile, the simultaneous inter-row locking inhibiting member 10 further has another plurality of receiving portions 12 projectingly formed at positions on the other edge thereof each of which positions corresponds substantially to the center between adjacent ones of the receiving portions 11 on the one edge of the simultaneous inter-row locking inhibiting member 10. Each of the receiving portions 12 on the other edge of the simultaneous inter-row locking inhibiting member 10 has a tapered face 12a on a side thereof opposite to the tapered face 11a on the one side of the receiving portion 11. A lower edge of a given tapered face 12a is aligned with a lower edge of one of the tapered faces 11a of the simultaneous inter-row locking inhibiting member 10.

Figure 5:
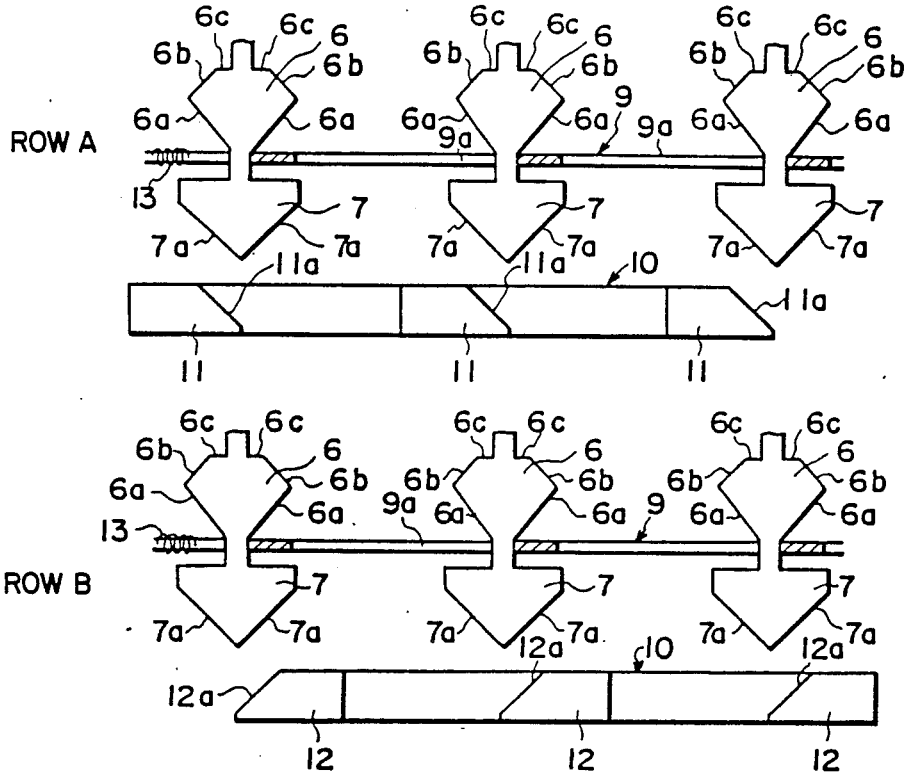
FIG. 5 is an enlarged cross sectional view illustrating a general construction of the device of FIG. 1 with the switches all left in respective normal inoperative positions.
Figure 6:
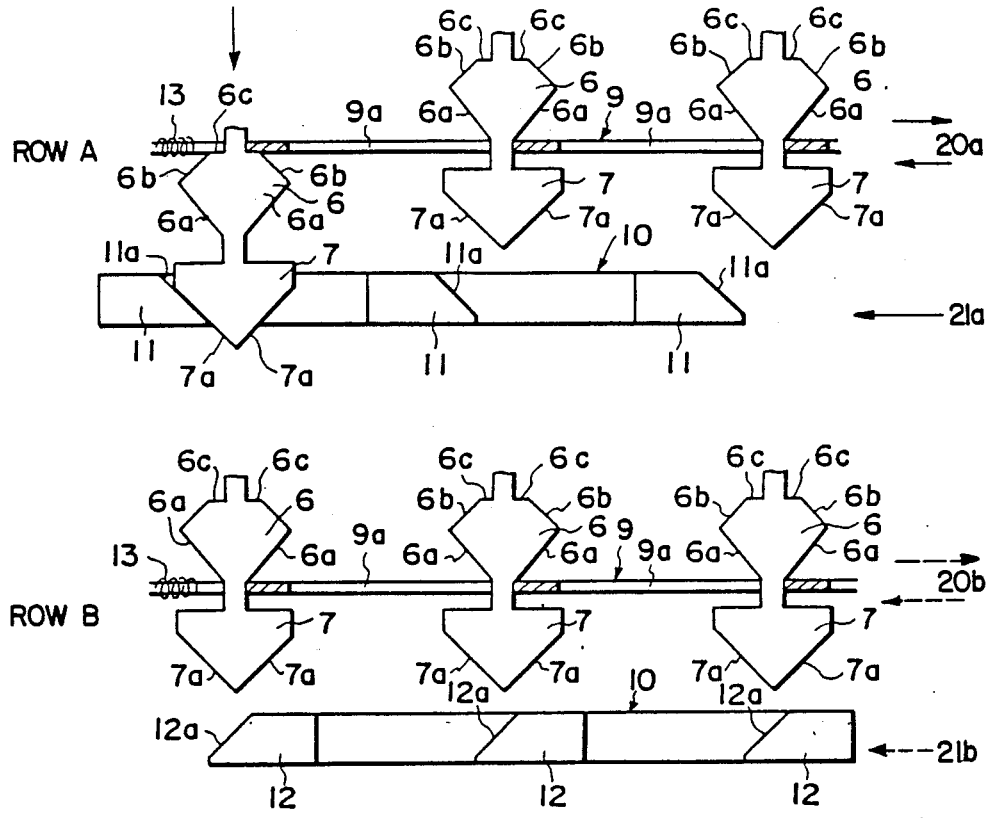
FIG. 6 is a similar view but illustrating a selected one of the switches depressed to its operative position.

Here, operation of the simultaneous inter-row locking inhibiting mechanism having such a construction as described above will be described with reference to FIGS. 5 to 9. For simplicity, the two row embodiment having the three switches in each of Row A and Row B will be described. However, the same principles are applicable to other switch mechanisms having other numbers of switches and rows. Referring first to FIG. 5, all of the switches of Rows A and B are shown in normal inoperative positions. In FIG. 6, if the slide 3 of the left (in the drawing) one of the switches 2 in Row A is depressed, the right tapered lowering guide face 6a of the interlocking cam operating portion 6 formed on the front wall face of the slide 3 pushes the interlocking cam 9 to move in the right horizontal direction of solid arrow 20a for Row A and dashed arrow 20b for Row B while the left tapered face 7a of the controlling portion 7 of the slide 3 is engaged with one of the tapered face 11a of the corresponding receiving portion 11 of the simultaneous inter-row locking inhibiting member 10 and pushes the same to the left direction of solid arrow 21a. Consequently, the inhibiting member 10 as a whole is moved to the left, including the receiving portions 12 on the side of Row B, as indicated by the dashed arrow 21b. After being moved to the right by the downward movement of tapered face 6a of the left switch in Row A, interlocking cam 9 is returned by means of a returning spring 13 to its initial position in which it is engaged with the stopping faces 6c of the interlocking cam operating portion 6 of the slide 3 to thus lock the slide 3 in a depressed operative position. Left solid arrow 20a for Row A and left dashed arrow 20b for Row B represent the return movement of interlocking cam 9.

In this instance, the cam operating portion 5 on the rear wall face of the slide 3 moves the associated locking cams 8 to a position in which they prevent the slides 3 of the remaining switches 2 in the row from being depressed, thereby inhibiting simultaneous locking of the switches 2 in the row.

Figure 7:
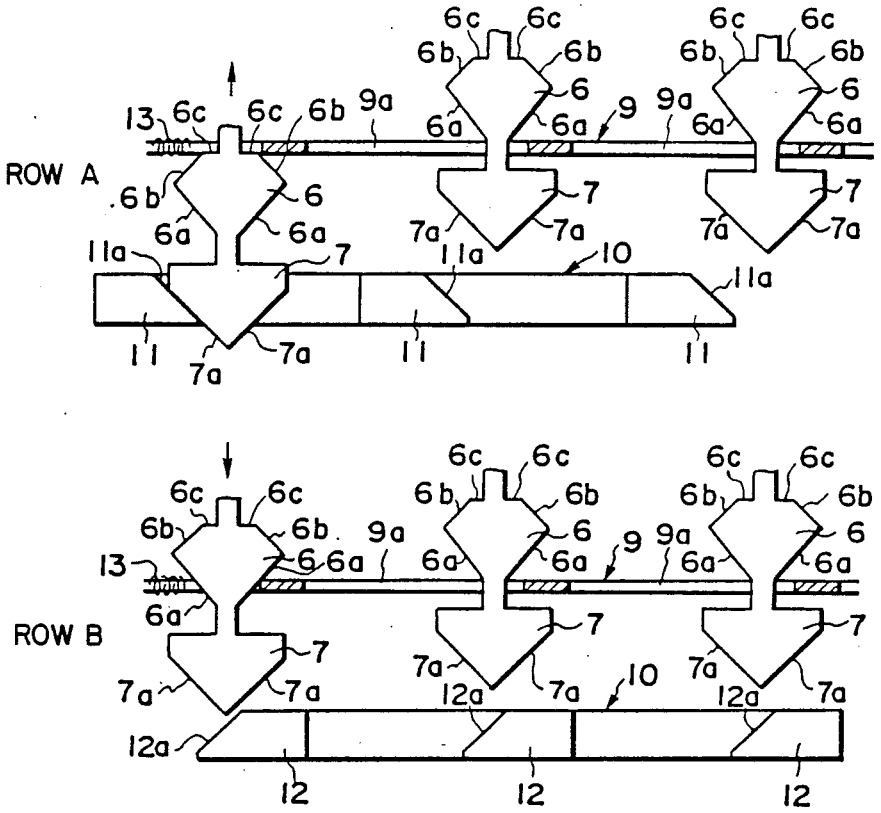
FIG. 7 is a similar view but illustrating a different switch in a different row being depressed toward its operative position.
Figure 8:
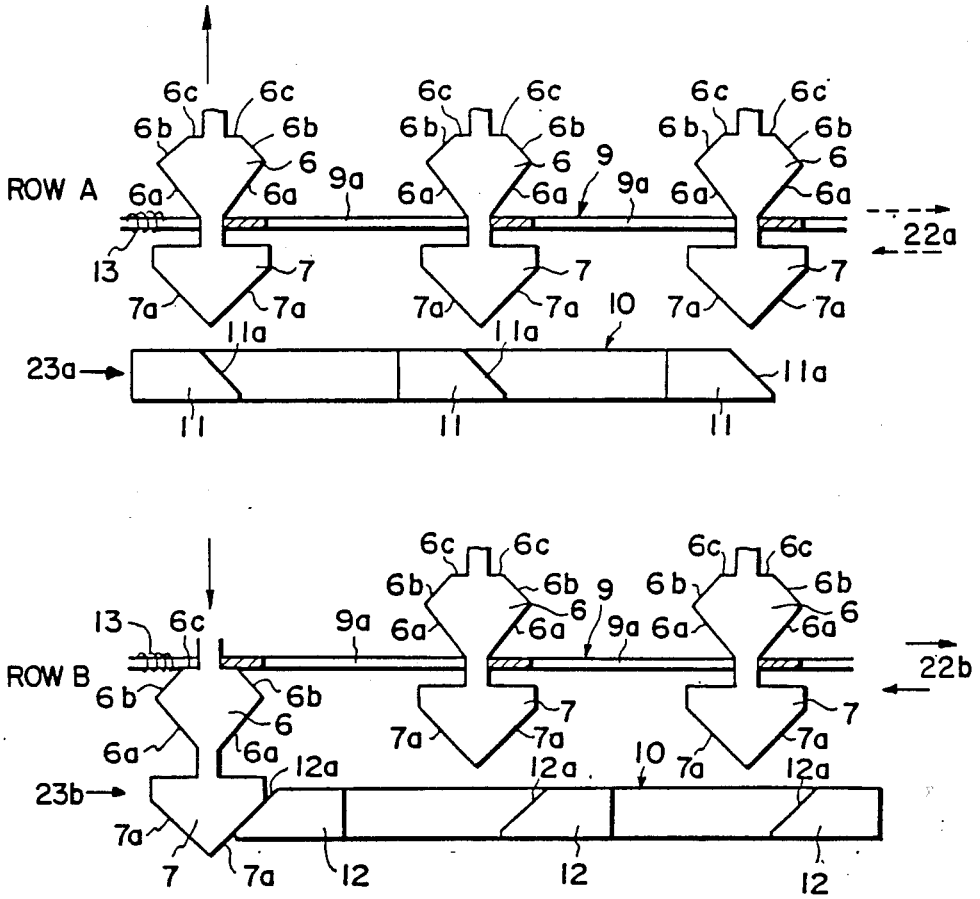
FIG. 8 is a similar view but illustrating the different switch in the different row of FIG. 7 having been fully depressed to its operative position.

Then, in this condition, if the slide 3 of a selected one of the switches 2 in Row B is depressed, e.g. the left switch in FIG. 7, the right guide face 6a of the interlocking cam operating portion 6 formed on the slide 3 of the switch 2 pushes the interlocking cam 9 to move to the right direction of solid arrow 22b for Row B and dashed arrow 22a for Row A in FIG. 8. At the same time, the left switch in Row A is released by the horizontal movement of the interlocking cam 9, and the slide 3 which was in the locked condition is returned by the biasing spring to its initial position with one of the tapered rising guide faces 6b being slidably contacted with the interlocking cam 9, thereby releasing the locking condition of the first switch 2. Meanwhile, the right tapered face 7a of the controlling portion 7 of the left switch of Row B is engaged with the tapered face 12a of a corresponding one of the receiving portions 12 of the simultaneous inter-row locking inhibiting member 10 and pushes the same to move in the left direction of solid arrow 23b for Row B and dashed arrow 23a for Row A. The cam 9 is pushed by the right lowering face 6a and then returned by spring 13 to the initial position (left dashed arrow 22a for Row A and left solid arrow 22b for Row B) in which the left switch of Row B is held at face 6c in the locked condition.

Figure 9:
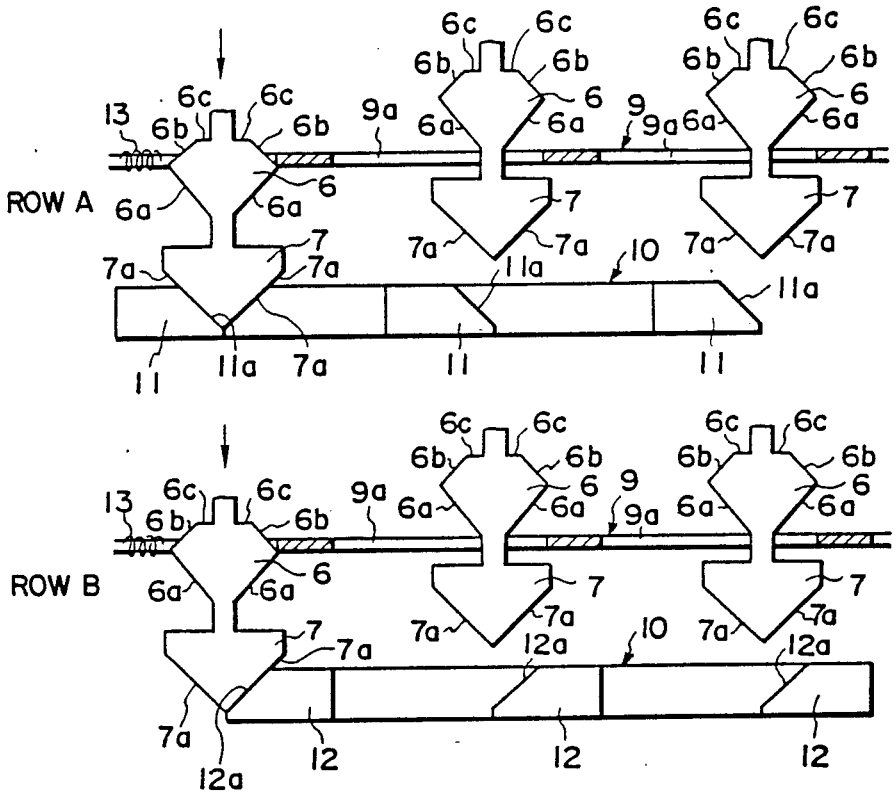
FIG. 9 is a similar view but illustrating different switches in different rows being depressed toward their operative positions at a same time.

On the other hand, if the slides 3 of selected switches 2 in Rows A and B are depressed at a time, as indicated in FIG. 9 there will be no movement of the simultaneous inter-row locking inhibiting member 10 caused thereby because the tapered faces 7a of the controlling portions 7 of the slides 3 of the depressed switches 2 are engaged simultaneously with the tapered faces 11a and 12a of the corresponding receiving portions 11 and 12, respectively, of the simultaneous inter-row locking inhibiting member 10 to push the same in opposite, blocking directions. Accordingly, both switches 2 thus depressed will not be locked at the same time.

As apparent from the foregoing description, according to the present invention, simultaneous locking of switches in different rows in a multi-row interlocking switch device can be inhibited.

What is claimed is:

1. A multi-row interlocking switch device comprising:

a chassis;

a plurality of rows of switches arranged in one plane of said chassis, each row having a plurality of switches, and each switch having a slide member depressable against a spring force to a depressed position, and means in said chassis for releasably locking a slide member in the depressed position;

each slide member of each switch having an engaging portion with a downwardly tapered face formed thereon; and a member for inhibiting the simultaneous locking of switches in two different rows in depressed positions, said inhibiting member being formed by a plate displaceably movable parallel to said plane of said chassis and having a plurality of rows of receiving portions corresponding to the rows of switches and to the number of switches in each row, wherein the receiving portions in any one row are each formed with a tapered face positioned to be engageable with the tapered face of the engaging portion of each slide member of each switch in said one row, such that depression of a slide member of any switch in said one row results in displacement of said inhibiting member in one direction, and wherein the receiving portions of said inhibiting member for switches in a different row are positioned such that depression of a slide member of any switch in said different row results in displacement of said inhibiting member in a direction opposed to said one direction, whereby when a slide member in one row is depressed and locked in the depressed position by said releasably locking means, said inhibiting member is displaced in said one direction and locked in the displaced position by said one locked slide member, and if it is attempted to depress a different slide member of a different row, the different slide member is locked out from being depressed by said inhibiting member being locked in the displaced position, and thereby simultaneous depression of slide members of switches in the different rows is prevented.

2. A mechanism according to claim 1, wherein a lower edge of said tapered face on said one row of a given one of said receiving portions of said simultaneous locking inhibiting member is aligned with a lower edge of a receiving portion on said different row.

3. A mechanism according to claim 1, further comprising means provided for each of said rows of said switches for inhibiting simultaneous locking of said switches in each of said rows.

4. A mechanism according to claim 3, wherein said simultaneous inhibiting locking means includes a plurality of locking cams, each of said locking cams being substantially in the form of a bar disposed between adjacent switches in a given row and mounted for horizontal movement such that when one slide member of a switch is depressed, each of said locking cams is moved to a position in which the operation of other associated switches of the given row is inhibited by engagement of each of the locking cams with the slide member of the associated switch not intended to be activated.

5. A mechanism according to claim 4, wherein each of said switches has on its slide member a pair of tapered faces formed to intersect each other thereon, and each of the locking cams has formed at each of opposite ends thereof a tapered face which is tapered in a same angle with said tapered faces of said slide member and an engaging face for engagement with said engaging face of an adjacent one of said locking cams.

* * * * *